United States Patent [19]

Shamlian

[11] 4,017,925

[45] Apr. 19, 1977

[54] SWIM FIN INCLUDING MEANS FOR RESTRICTING ANKLE MOVEMENT

[75] Inventor: Ralph B. Shamlian, San Francisco, Calif.

[73] Assignee: Farallon Industries, Inc., Belmont, Calif.

[22] Filed: Jan. 30, 1976

[21] Appl. No.: 653,943

Related U.S. Application Data

[63] Continuation-in-part of Ser. No. 540,908, Jan. 14, 1975, Pat. No. 3,978,537.

[52] U.S. Cl. ..... 9/309

[51] Int. Cl.[2] ..... A63B 31/08

[58] Field of Search ..... 9/301, 303, 304, 305, 9/306, 309

[56] References Cited

UNITED STATES PATENTS

| | | | |
|---|---|---|---|
| 1,114,466 | 10/1914 | Goodenberger | 9/303 |
| 1,671,324 | 5/1928 | Speziale | 9/303 |
| 3,239,857 | 3/1966 | Gwynne | 9/309 |

*Primary Examiner*—Trygve M. Blix
*Assistant Examiner*—Sherman D. Basinger
*Attorney, Agent, or Firm*—Lowhurst & Aine

[57] ABSTRACT

In a swim fin, members are provided for maintaining a swimmer's foot in a predetermined angular relationship with respect to the swimmer's leg, particularly during a downward kick or leg extension mode. Movement of the ankle relative to the leg is substantially restricted, and stress that would be placed on the ankle in the utilization of a prior swim fin is transmitted to the leg. In two embodiments, a rigid member, such as a wall or brace, extends from the foot-receiving portion of the fin to engage the swimmer's lower shin. Straps from the shin brace maintain the swimmer's leg and foot in the predetermined relationship to the swim fin. Adjustable members may be provided for adjusting the selected, angular relationship between the shin brace and the swimmer's foot and leg. In a third embodiment, a tubular assembly is provided for engaging a lower rear portion of the swimmer's leg, preferably below the calf. In this embodiment, the engaging assembly is provided to pivot for facilitating walking and standing while wearing the fin. It is also adjustable for fitting feet of different sizes.

20 Claims, 13 Drawing Figures

SWIM FIN INCLUDING MEANS FOR RESTRICTING ANKLE MOVEMENT

RELATED APPLICATIONS

This is a continuation-in-part of application Ser. No. 540,908, filed Jan. 14, 1975, and now U.S. Pat. No. 3,978,537 entitled Swim Fin Including Means For Maintaining Foot and Leg in Fixed Relationship.

BACKGROUND OF THE INVENTION

The present invention relates to foot-mounted swim fins such as are used by underwater swimmers.

DESCRIPTION OF THE PRIOR ART

The type of swim fin comprehended by the present invention comprises a foot-receiving portion and a blade extending forwardly from the foot. Such swim fins are occasionally referred to as "flippers." The foot-receiving portion may comprise either a pocket for receiving a forward portion of the foot and a heel strap or may comprise a shoe-like foot receptacle.

In use, swim fins enable a swimmer to increase propulsive forces created by his legs. They are useful to both surface swimmers and scuba (underwater) divers, but are of greatest significance in scuba applications since scuba divers depend primarily on their legs and feet for propulsion. Typically, a scuba diver performs the flutterkick, which is a scissor-like motion of almost outstretched legs. Reactive forces are generated in response to the motions of the leg and foot against the water during most of the kick. In the utilization of swim fins, the magnitude of the reactive forces is multiplied by the fin blade as a function of its surface area. As one leg of the swimmer, and hence the blade, moves down through the water, it is the propulsive, upper surface of the blade on which reactive forces operate. Those components of reactive forces which are resolved parallel to the longitudinal axis of the body contribute to forward motion, and are defined as thrust. The reaction of the blade to the water in response to the downward, or power, kick produces forward thrust.

Over the last 80 years there have been literally hundreds of proposals for improving fins, many of which are embodied in the traditional types of fins known today. With modern fins, manufacturers have varied the blade length, stiffness and width, adding vents, full foot pockets, adjustable straps, etc. Most efforts to increase swimming efficiency have been in designs related exclusively to the blade area of fins. Little has been done heretofore to compensate for the weakness of the ankle joint and to couple the energy of the leg efficiently to a fin attached to the foot.

Considering the ankle joint, one will note that when sitting on the edge of a table with a foot free of the floor, the foot can be fully moved up and down about the transverse axis of the ankle, from side to side about the axis of the leg and in a rolling motion about the axis of the foot. This is possible because the ankle is a fully articulated joint and, as such, it is one of the weakest joints in the body.

When a conventional fin is strapped to a leg and the leg is moved stiffly up and down in water in a plane called the kick plane, two distinct things occur. First, the fin tends to move from side to side. This is called "yaw." Second, the fin tends to twist about its longitudinal axis; this is called "roll." Both yaw and roll are caused by hydrodynamic forces acting on the thrust-producing surfaces of the fin. When they occur, water spills off the sides of the fin, which reduces forward thrust. They occur when using conventional fins because of the relative weakness of the ankle joint. Relatively high ribs on fins can somewhat reduce the spillage, but still, a considerable loss of efficiency is experienced with conventional fins due to a lack of any practical means for preventing the undesired yaw and roll, especially if, through strain and long use, a swimmer's ankles become tired. The larger the blade, the greater is the problem of yaw and roll because of the larger thrust-producing surface.

In addition to problems associated with increased area, there are also problems associated with a blade of increased length because there is also a tendency for increased planar flexion of the foot relative to the leg.

The force produced in response to which propulsive reactive forces are produced are provided by the swimmer's legs. Since the swim fins are foot mounted, the force must be transmitted through the swimmer's ankles. In pushing a swim fin down with the lower leg, planar flexion results. Planar flexion is the rotation of the foot downwardly or away from the lower leg. The greater the amount of force provided, the greater is the amount of planar flexion that can result. In other words, those parameters — e.g., blade size or force of kick — which produce desirable forward thrust also produce planar flexion.

Planar flexion can overextend ligaments in the leg and foot and can also result in cramps in the ankle, arch and lower leg. The effects of planar flexion are significant because the ankle joint is undeveloped and weak compared to many other parts of the body. It is well known that even professional athletes can sprain an ankle from an act as simple as stepping off a curb. Thus in the employment of swim fins, there is a natural tension between providing maximum forward thrust and placing maximum strain on muscles and ligaments of the ankle.

Blade length is also a very important criterion in fin performance for other reasons. The shorter the blade, the more one has to bend one's foot in order to bend the blade back far enough to develop the forward thrust component of the kick stroke. The longer the blade, the shorter the distance one has to move his leg in order to bend the blade. Thus, for a given kick stroke, the longer the blade, the greater will be the forward thrust produced.

It can be seen from the foregoing, therefore, that when using a large-bladed fin, a great deal of strain is placed on the ankle joint, not only to prevent yaw and roll, but also to prevent angular rotation or planar flexion of the foot about an axis transverse to the longitudinal axis of the leg.

SUMMARY OF THE INVENTION

It is therefore an object of the present invention to provide a swim fin which provides for minimized planar flexion in use.

It is also an object of the present invention to provide a swim fin including means for assisting a swimmer in maintaining the fin blade normal to a kick plane, whereby spillage is reduced and whereby a maximum forward force vector is produced in response to a kick.

It is a further object of the present invention to provide a swim fin of the type described in which a swimmer's ankle is substantially rigidly maintained such that his foot is maintained at a comfortable angle with respect to his lower leg and such that wobbling of the swimmer's foot due to stress on the ankle joint is reduced or eliminated.

It is also an object of the present invention to provide a swim fin of the type described in which the fixed angle between the swimmer's foot and lower leg is selectable.

It is another object of the present invention to provide a swim fin of the type described providing support to ligaments and musculature in the vicinity of the ankle.

It is yet another object of the present invention to provide a swim fin of the type described including means for enabling a swimmer to transfer energy directly from well-developed leg muscles to a fin blade directly, without coupling such forces through the ankle.

It is also a specific object of the present invention in one form to provide a swim fin of the type described which maintains a fixed angular relationship between the swimmer's foot and lower leg during a downward kick, or leg extension and yet permits the swimmer to stand erectly while wearing the swim fin.

Another object of the present invention is a swim fin with means for reducing ankle strain and yaw and roll of a foot relative to a leg, and which permits the transmission of a greater amount of the energy in a leg to the fin.

Another object of the present invention as described above is a fin having an enlarged blade with means for facilitating walking and standing while wearing the fin.

Still another object of the present invention is a fin including one or more of the above described features comprising means for adjusting the fin for use on feet of different sizes.

Briefly stated, in accordance with the present invention, there is provided a foot-mounted swim fin including bracing means extending from a foot-receiving portion for maintaining the foot at a predetermined angle with respect to the leg. In one form a rigid extension projects upwardly from the foot-receiving portion for engagement against the forward portion of the lower leg. The lower leg and heel are strapped against the foot-receiving portion and extension. The lower leg and foot are rigidly mounted to the swim fin. Planar flexion is prevented.

In accordance with another embodiment of the above objects, there is provided in a swim fin having a foot pocket, a tubular assembly having a free end extending from opposite sides of the foot pocket. Mounted to the free end of the tubular assembly is a relatively rigid semi-circular cuff. The cuff is mounted in a position to fit around the back of the leg just below the calf. A neoprene pad is cemented to the inside of the cuff for comfort and to prevent slippage. A flexible strap is secured to the ends of the cuff for fitting around the front of the leg and holding the cuff against the leg.

The tubular assembly comprises a pair of lower tubular members which are fitted respectively to the sides of the foot pocket, a pivotable elbow and a pair of upper tubular members which support the cuff. The pivotable elbow permits limited rotation of the upper tubular members and cuff relative to the foot pocket about an axis transverse to the ankle. The limited rotation facilitates walking and standing while wearing the fin and permits a preferred amount of downward rotation of the foot relative to the leg during swimming.

Fitted to the lower tubular members are a heel strap and a pair of knurled dial-adjusting members for adjusting the position of the elbow, upper tubular members, cuff and strap relative to the foot pocket.

In effect, what the fin of the present invention does is to strap the ankle in a position and prevent it from moving sideways (yaw and roll) and back (planar flexion) past a predetermined number of degrees, as of 35°, during a forward thrust-producing kick stroke.

BRIEF DESCRIPTION OF THE DRAWINGS

The means by which the foregoing objects and features of novelty are achieved are pointed out with particularity in the claims forming the concluding portion of the specification. The invention, both as to its organization and manner of operation, may be further understood by reference to the following drawings.

In the drawings.

DESCRIPTION OF THE PREFERRED EMBODIMENTS

Figure 1:
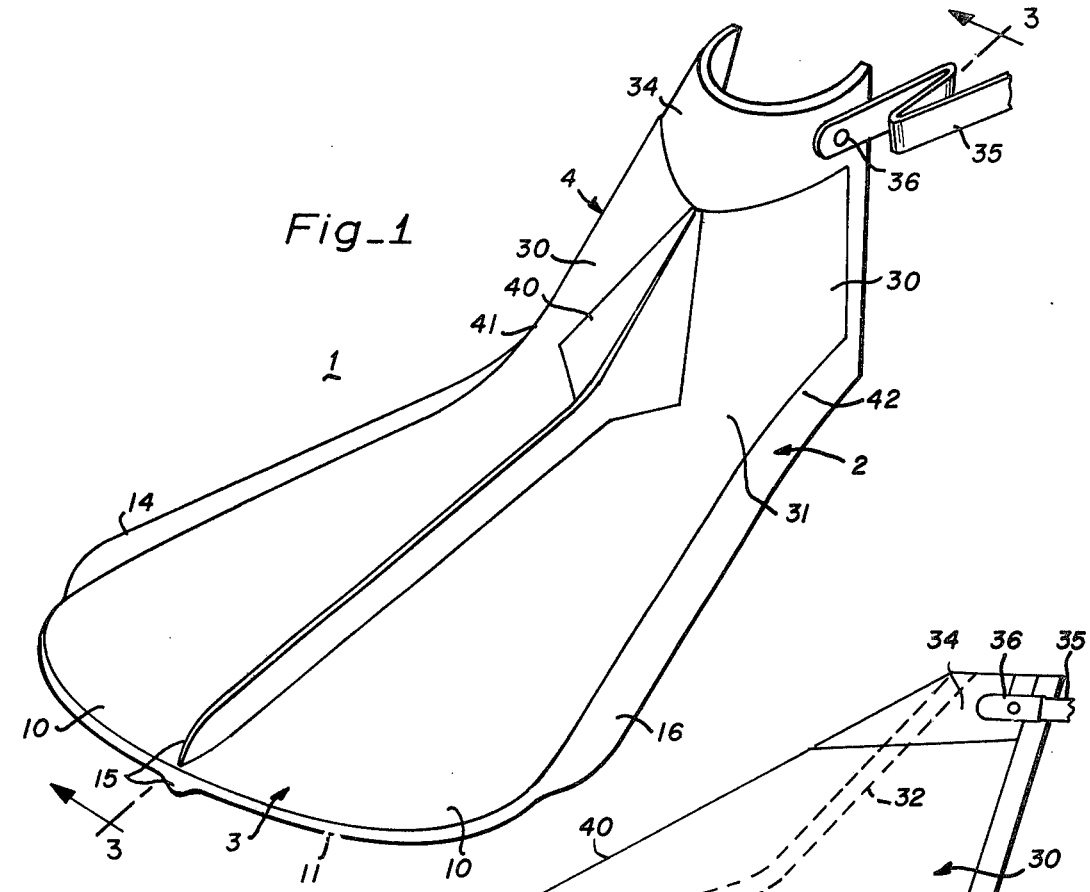
FIG. 1 is a perspective view of a swim fin constructed in accordance with the present invention.
Figure 2:
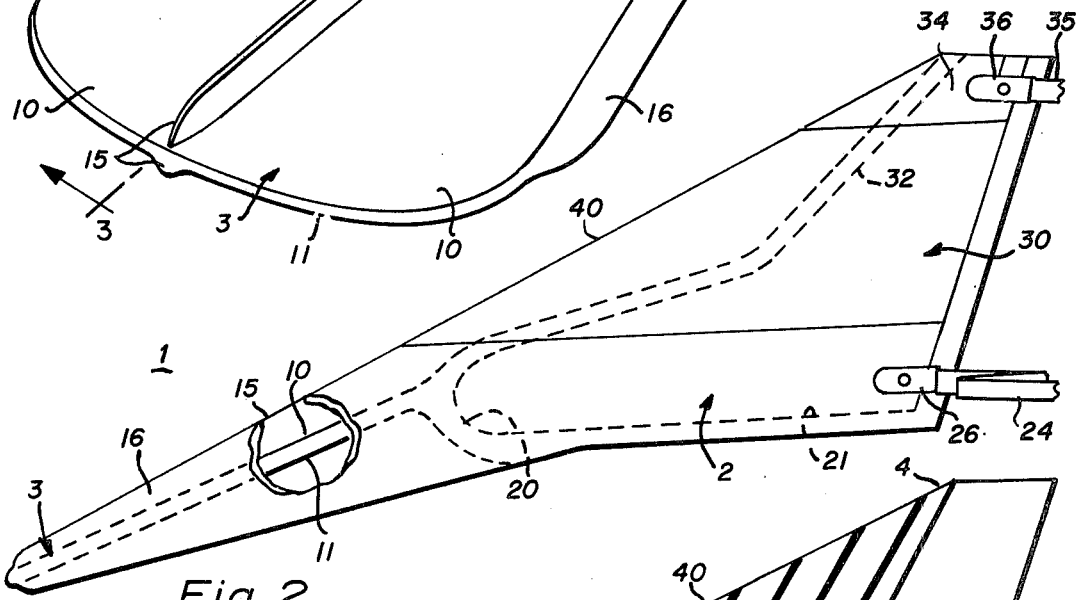
FIG. 2 is a side elevation of the embodiment of FIG. 1, partially broken away to illustrate further the blade of the swim fin.
Figure 3:
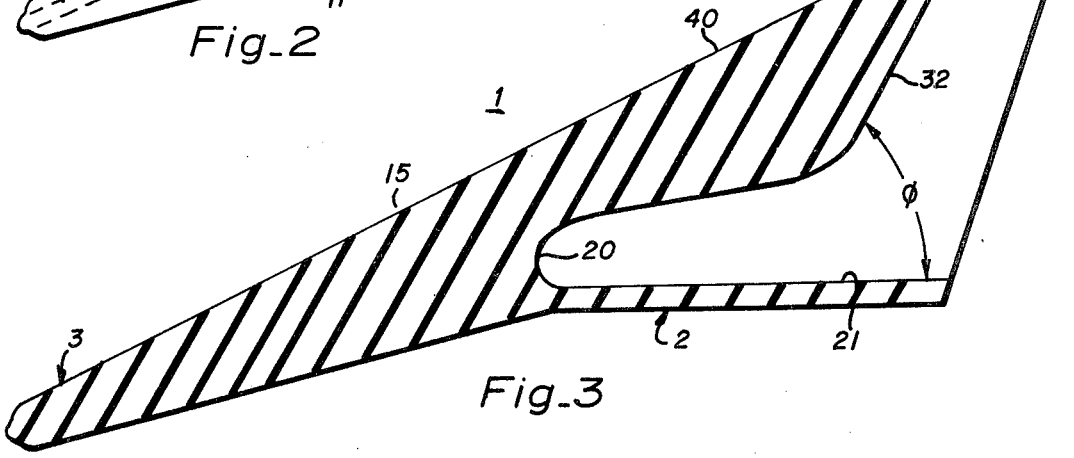
FIG. 3 is a cross-sectional view taken along lines 3—3 of FIG. 1.

Referring now to FIGS. 1, 2 and 3, there is illustrated a first embodiment of a swim fin 1 constructed in accordance with the present invention. FIG. 1 is a perspective view of the swim fin 1, FIG. 2 is a side view of the swim fin 1, and FIG. 3 is a cross-sectional view taken along line 3—3 of FIG. 1, which line comprises the longitudinal axis of the swim fin 1. The swim fin 1 includes a foot-receiving portion 2 and a blade 3 extending longitudinally forward thereof. In accordance with the present invention, a leg-bracing portion 4 is provided extending upwardly from the foot-receiving portion 2 and cooperating therewith. As described in further detail below, the leg-bracing portion 4 in cooperation with the foot-receiving portion 2 provides for improved imparting of energy to the blade 3 and for improved response to reactive forces acting on the blade 3.

The swim fin 1 is described in greater detail referring first to the blade 3. The blade 3 has an "upper" surface 10 and a "lower" surface 11, both extending forwardly of the foot-receiving portion 2. The terms upper, lower and forward denote orientation with respect to the foot of a swimmer. FIG. 2 is partially broken away to better illustrate the surfaces 10 and 11. In use, the upper surface 10 of the blade 3 is forced against the water by the leg of a swimmer in order to produce the above-described reactive forces. The surface 10 is the propulsive surface.

Longitudinally extending dihedral ribs 14, 15 and 16 are provided formed integrally with the blade 3. The ribs 14 and 16 are spaced at lateral (perpendicular to longitudinal) sides of the blade 3, and the rib 15 is formed in the lateral center of the blade 3. The ribs 14, 15 and 16 project from both the upper and lower surfaces 10 and 11 of the blade 3. The dihedral surfaces of the ribs 14, 15 and 16 provide for hydrodynamic stability of the blade 3. The ribs 14, 15 and 16 are hydrodynamically shaped to aid in maintaining the surface 10 in a disposition normal to the kick plane during each kick. The blade 3 may be a solid blade, as illustrated. Alternatively, the blade 3 may comprise any one of a number of forms of well-known vented fins.

The foot-receiving portion 2 may, as shown in the present embodiment, comprise a pocket 20 for receiving the portion of a foot forward of the ankle. The pocket 20 includes a base 21 for bearing against the sole of a foot. In other embodiments, the foot-receiving portion 2 may comprise a well-known "shoe." In the present embodiment, a heel strap 24 is provided mounted to the pocket 20 by conventional fastening means 26. The heel strap 24 is fastened around the back of a swimmer's foot in order to maintain the foot in engagement with the pocket 20.

The leg-bracing portion 4 cooperates with the foot-receiving portion 2 to provide a fixed angular relationship between the foot and the leg. In the present embodiment, a wall 30 is provided rising from a junction 31 with the foot-receiving portion 2 located above the pocket 20. The wall 30 is formed extending laterally across the fin 1 and having a rearwardly-directed contoured inner surface 32 (FIG. 3). The inner surface 32 is positioned for abutment against a lower leg when a foot is inserted in the pocket 20. A top portion 34 of the leg-bracing portion 4 has mounted thereto a strap 35 by means of a conventional fastener 36. The strap 35 is fastened around the lower leg of the swimmer and retained by a conventional fastener (not shown) laterally opposite the fastener 36. With the straps 24 and 35 fastened, the foot is engaged in the pocket 20, and the lower leg is maintained against the surface 32. The wall 30 is constructed to be rigidly positioned with respect to the foot-receiving portion 2. In this manner, the angular relationship of the foot to the lower leg is fixed. Stress is thus relieved from the ankle joint during propulsive kicks. Many convenient means may be used to produce a wall 30. Well-known rigid thermosetting materials could be used for example.

Swim fins are typically made of an elastomer such as natural or synthetic rubber having a durometer of between sixty and ninety. In the present embodiment, the swim fin 1 is integrally molded out of one typical swim fin material. To provide sufficient structural strength for imparting sufficient rigidity to the wall 30, a bracing rib 40 is formed in the leg-bracing portion 4. The bracing rib 40 extends along the longitudinal axis of the swim fin 1 and is located in the lateral center of the leg-bracing portion 4. The bracing rib 40 extends from the rib 15 to the top portion 34. The bracing rib 40 is formed to be wide with respect to the rib 15 at the point at which it is in registration with the junction 31 and is tapered toward the top portion 34. The bracing rib 40 is preferably a dihedral rib, forming an integral rib in combination with the rib 15. Such construction of the bracing rib 40 provides for structural integrity as well as hydrodynamic shape. For further structural integrity and hydrodynamic design, ribs 41 and 42 may be provided extending longitudinally from the ribs 14 and 16 respectively to the lateral sides of the swim fin 1. The surface 32 in the plane of FIG. 3 (i.e., a plane tangent to the surface 32 at its laterally forward end) is canted at an angle $\phi$ selected in fabrication with respect to the base 21 which provides a comfortable fixed relationship of the lower leg to the foot, and which provides a satisfactory disposition of the blade 3 and the water during kicks. It has been found that a suitable value of $\phi$ is 65°.

For purposes of the present description, the angle $\phi$ may also be used to describe the angle between the longitudinal axis of the lower leg and the longitudinal axis of the foot.

OPERATION

Figure 4:
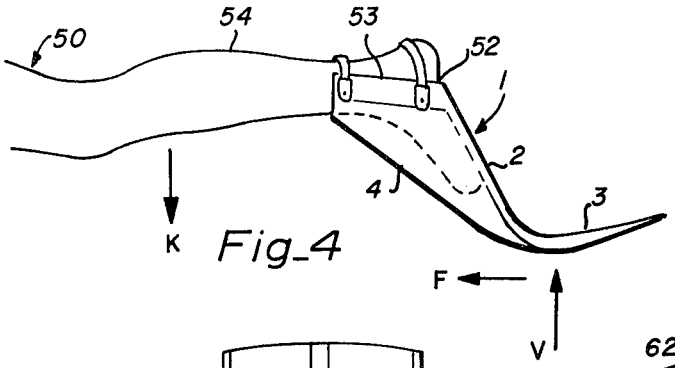
FIG. 4 is an illustration demonstrating the operation of the present invention.

Operation of the swim fin 1 is illustrated in FIG. 4, in which the same reference numerals are used to denote elements corresponding to those of FIGS. 1, 2 and 3. In FIG. 4, a swimmer's leg 50 is shown operating a swim fin 1 worn on his foot 52, ankle 53 and lower leg 54. The downstroke of the leg 50 provides a force K, which is transmitted to the swim fin 1. The blade 3 engages the water and reactive forces are produced including a reactive force vector F comprising the forward thrust vector. The vector F is resolved from a force vector V against the swim fin 1 produced in reaction to the downward kick. The force vector V must be borne by the ankle when the swimmer is wearing conventional fins. Using the swim fins of the present invention, the force vector V exerted on the foot-receiving portion 2 and the moment exerted by the blade 3 are transmitted by the leg-bracing portion 4 to the leg 50. Consequently, the well-developed musculature of the leg 50 may assist in creating propulsive force. At the same time, a minimized amount of force is transmitted to the ankle 53. Because the foot 52 is mounted rigidly with respect to the leg 54, planar flexion is eliminated. Further advantages of the rigid mounting of the leg include increased propulsion since wobbling of the foot with respect to the ankle is substantially eliminated. The blade 3 is maintained perpendicular to the kick plane. Consequently, the full surface 10 of the blade 3 is presented to the water. Spillage of water across the surface 10 is greatly reduced. Additionally, rotation of the blade 3 about an axis defined by the lower leg 54 is substantially eliminated. Because force is relieved from the ankle 53, the incidence of cramps in the ankle, arch and foot is reduced. Increased efficiency in propulsion is provided.

Figure 5:
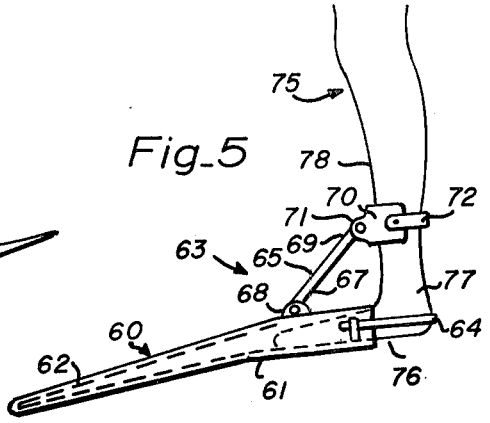
FIG. 5 is a side elevation of a further embodiment of the present invention.

FIG. 5 is an illustration of a further embodiment of the present invention. A swim fin 60 is provided for mounting on a leg 75 including a foot 76, ankle 77 and lower leg 78. The swim fin 60 comprises a foot-receiving portion 61, a blade 62 and a leg-bracing portion 63.

A conventional heel strap 64 is provided for holding a swimmer's foot in the foot-receiving portion 61. The leg-bracing portion 63 includes a rigid brace 65.

The angle $\phi$ between the foot 76 and the lower leg 78 is a function of the length of the brace 65. The brace 65 is adjustable in length so that the swimmer may select a comfortable angle $\phi$. Adjustability may be provided by any of a number of conventional, well-known means, for example by the use of a brace 65 comprising telescoping tubes.

The brace 65 has a first end 67 mounted to the foot-receiving portion 62 by mounting means 68. An opposite end 69 of the brace 65 engages a leg mount 70 at mounting means 71. The mounting means 68 and 71 include means for pivotally engaging the opposite ends of the brace 65 in order to allow for differences in the angle $\phi$ due to selection of the length of the brace 65. The leg mount 70 is curved to provide a surface abutting the lower leg 78. A leg strap 72 is utilized to maintain the leg mount 70 in engagement with the lower leg 78. When the swim fin 60 is mounted on the foot 76 the brace 65 is maintained by the foot-receiving portion 2 and leg mount 70 in a fixed angular relationship. Since the foot 76 and lower leg 78 are maintained in a fixed angular relationship, the above-described advantages are obtained. The brace 65 may be constructed from stainless steel, fiberglass or other suitable material that is sufficiently rigid to maintain an angle $\phi$ in response to a downward kick and which does not corrode in salt water.

Figure 8:
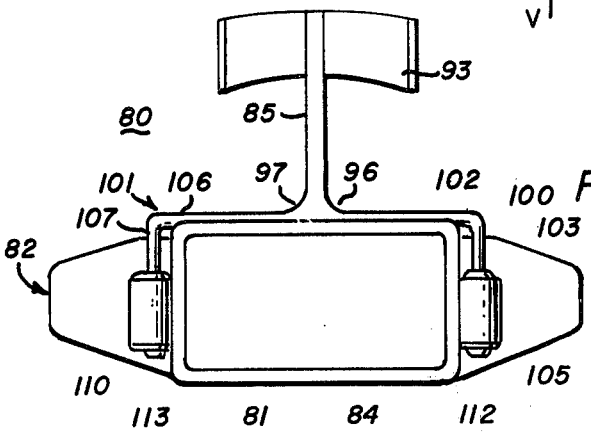
FIG. 8 is a rear elevation of the embodiment of FIG. 6.
Figure 6:
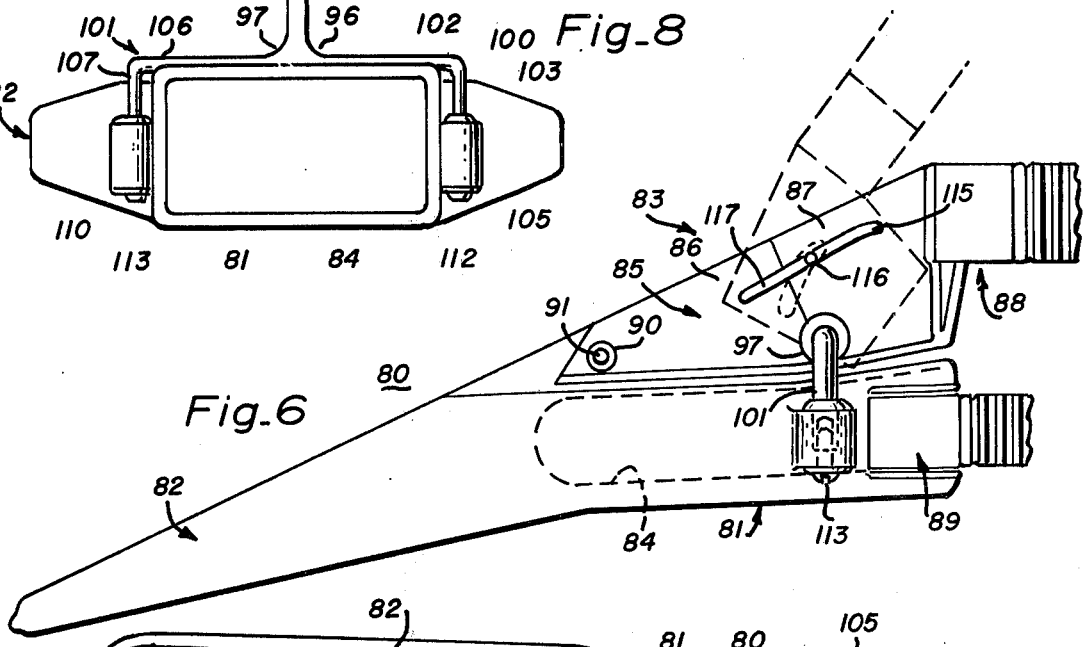
FIG. 6 is a side elevation of another embodiment of the present invention.
Figure 7:
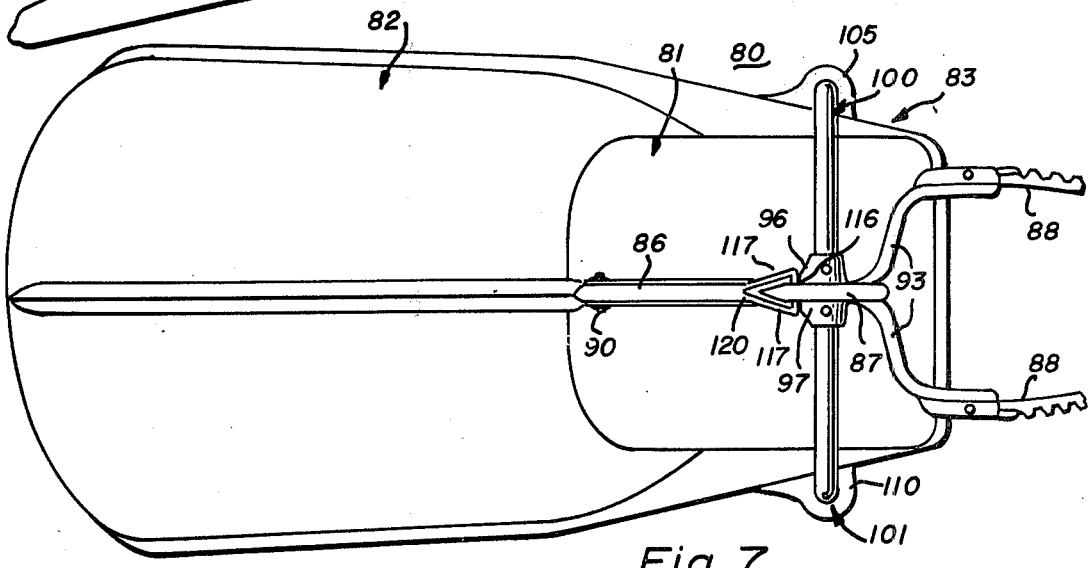
FIG. 7 is a plan view of the embodiment of FIG. 6.

FIGS. 6, 7 and 8 are side elevation, plan and rear elevation views of a further embodiment of the present invention. This embodiment provides for a selected angle $\phi$ maintained during a downward kick. Additionally, means are provided for permitting a swimmer to stand erectly while wearing the swim fins. A swim fin 80 is provided having a foot-receiving portion 81, a blade 82 and a leg-bracing portion 83. The foot-receiving portion 81 may comprise a conventional foot-receiving pocket having a base 84 for engaging the sole of a foot. The blade 82 may be similar to the blade 3 and 62 of FIGS. 1 and 3 respectively. Leg strap and fastening means 88 and heel strap and fastening means 89 are provided.

Referring to FIG. 6, the leg-bracing portion 83 includes a laterally centrally disposed bracing rib 85 comprising rib sections 86 and 87. The bracing rib 85 may be of uniform lateral thickness, and is tapered, rising vertically and rearwardly from a pivotal mounting point 90 adjacent the rear of the blade 82. The upper rear end of the bracing rib 85 supports a leg mount bracket 93 (FIGS. 7 and 8), which is positioned vertically for abutting the lower leg of a swimmer. The foot-receiving portion 81 and blade 82 are made of conventional swim fin materials. It is desirable that the bracing rib 85 be made of a well-known strong, lightweight thermoplastic.

The bracing rib 85 is mounted to the mounting point 90 by means of fastening means 91. Rearwardly of the mounting point 90, laterally opposed bosses 96 and 97 are formed on the bracing rib 85, and the rib section 87 is pivotally mounted thereon. The rib section 86 is fixed between the mounting point 90 and the bosses 96 and 97.

In order to fix the distance between the base 84 of the foot-receiving portion 81 and the leg mount 93, and hence select the angle $\phi$, means are provided for fixing the vertical relationship of the bosses 96 and 97 to the foot-receiving portion 81. As best seen in FIG. 8, first and second L-shaped supports 100 and 101 are provided. Other convenient forms of support as will be apparent from the description below may be used. The L-shaped support 100 has a horizontal leg 102 having an end received in the boss 96, and a vertical leg 103. An end of the leg 103 is received in a boss 105 extending laterally from the foot-receiving portion 81. The L-shaped support 101 has a horizontal leg 106 having an end received in the boss 97, and a vertical leg 107. An end of the vertical leg 107 is received in a boss 110 extending laterally from the foot-receiving portion 81, laterally opposed to the boss 105. The L-shaped supports 100 and 101 may conveniently be made of stainless steel tubing. To provide adjustability, the lower ends of the legs 103 and 107 are provided with inner threads. First and second screws 112 and 113 are mounted to the bosses 105 and 110 respectively for rotation therein and for mating with the threads of the legs 103 and 107 respectively. Rotation of the screws 112 and 113 adjusts the height of the supports 100 and 101 with respect to the foot-receiving portion 81. Consequently, the rib 85 rotates about the pivotal mounting point 90, and the angle $\phi$ is selected.

In order to permit a wearer to stand while wearing a swim fin 80, the rib section 87 pivots about the bosses 96 and 97. In use, a typical value of $\phi$ is on the order of 65°. Such an angle $\phi$ does not permit a wearer to stand. When standing, the angle $\phi$ is approximately 90°. In use, a wearer loosens the leg strap 88. As he stands, his lower leg bears against the leg mount (or mounting bracket) 93. The leg mount 93 and the rib section 87 rotate about the bosses 96 and 97, so that the rib section 87 assumes the position shown in dotted lines in FIG. 6. To further facilitate this operation, a slot 115 is formed in the rib section 87. A pin member 116 is mounted in the slot 115 and supported by arms 117 extending from the rib section 86. A pin and slot relationship of the pin member 116 and slot 115 is provided for limiting rotation of the rib section 87 to, for example, the position shown in FIG. 6. The slot 115 is dimensioned such that on a downward kick, rotation of the rib section 86 with respect to the rib section 85 is limited such that the angle $\phi$ selected by adjustment of the legs 100 and 101 is maintained. A tapered groove 120 may be formed in the rear of the rib section 86 so that the rib section 87 may fit therein upon rotation.

From the foregoing, it is clear that other embodiments of a swim fin may be constructed in accordance with the invention as described with respect to FIGS. 1–7. A higher or lower leg-bracing portion and other forms of brace members could be provided.

Referring to FIGS. 9–13, there is provided in accordance with the present invention, a swim fin 201. Fin 201, like the fins of FIGS. 1–8, is adapted for fitting to each of the feet of a swimmer to enable the swimmer to manipulate his or her feet separately and independently of each other. A portion of the fin 1 comprises a blade 202 having an upper surface 203 and a lower surface 204. Along each of the side edges of blade 202 there is provided a rib 205. Each of the ribs 205 comprises an upper part **205*a* and a lower part 205*b* which, respectively, extend perpendicular from the surfaces 203 and 204. Located between the ribs 205 and extending perpendicular to the surfaces 203 and 204, there are provided, respectively, two pairs of center ribs 206 and 207. Each of ribs 205, 206 and 207 generally describe in a transverse cross-section a truncated triangle. In a typical embodiment, the base of each of the ribs is 11/16 inch and the top of each of the ribs is ⅛ inch. The blade 202 is generally symmetrical about a center line parallel to the longitudinal axis of the fin and is provided with an arcuate leading edge 208. The sides of the blade 202 generally flare outwardly in a direction toward its center from its forward and heel portions and in a typical embodiment is approximately 9⅜ inches at its widest point. In use, during a kick stroke, the ribs 205, 206 and 207** tend to direct water being removed from the surfaces of the blade in a direction parallel to the longitudinal axis of the blade. This has the effect of reducing yawing and rolling of the blade and, thereby, spillage of water from its sides which reduces forward thrust.

To the rear of the blade 202 and typically formed as an integral part thereof, is a foot pocket 210. Pocket 210 is provided for receiving a forward portion of the foot of a wearer. The forward portion received is the portion including the toes and the portion forward of the ankle. For comfort and fit the interior top and bottom surfaces of the pocket 210 are curved to generally correspond to the shape of the top and bottom surfaces of a foot. For example, the wall surface underneath the toes is raised somewhat from the surface area under the ball of the foot. Similarly, the upper rear edge of the opening into the foot pocket, as at 211, is curved forwardly in a direction toward the blade 202 to accommodate the curve of the upper surface of a foot in the vicinity of the ankle.

In a typical embodiment, the blade 202 is provided to have a downward taper of approximately 6° relative to a line parallel to a parting line, approximately centered with respect to the rear portion of the side walls of the foot pocket, the parting line being approximately 1¾ inches above the lower rear edge of the foot pocket. The taper is provided to begin approximately 9½ inches from the rear edges. From the point where the taper begins to the leading edge 208 of the blade 202, the blade thickness is provided to taper from approximately 7/32 to 3/16 inches. The length of the fin from the rearmost edge of the fin to its leading edge 208 is approximately 23 inches. It may be well to note at this juncture that a fin of that length is typically a good four to five inches longer than most fins now commercially available and is, therefore, capable of providing improved thrust performance.

Figure 9:
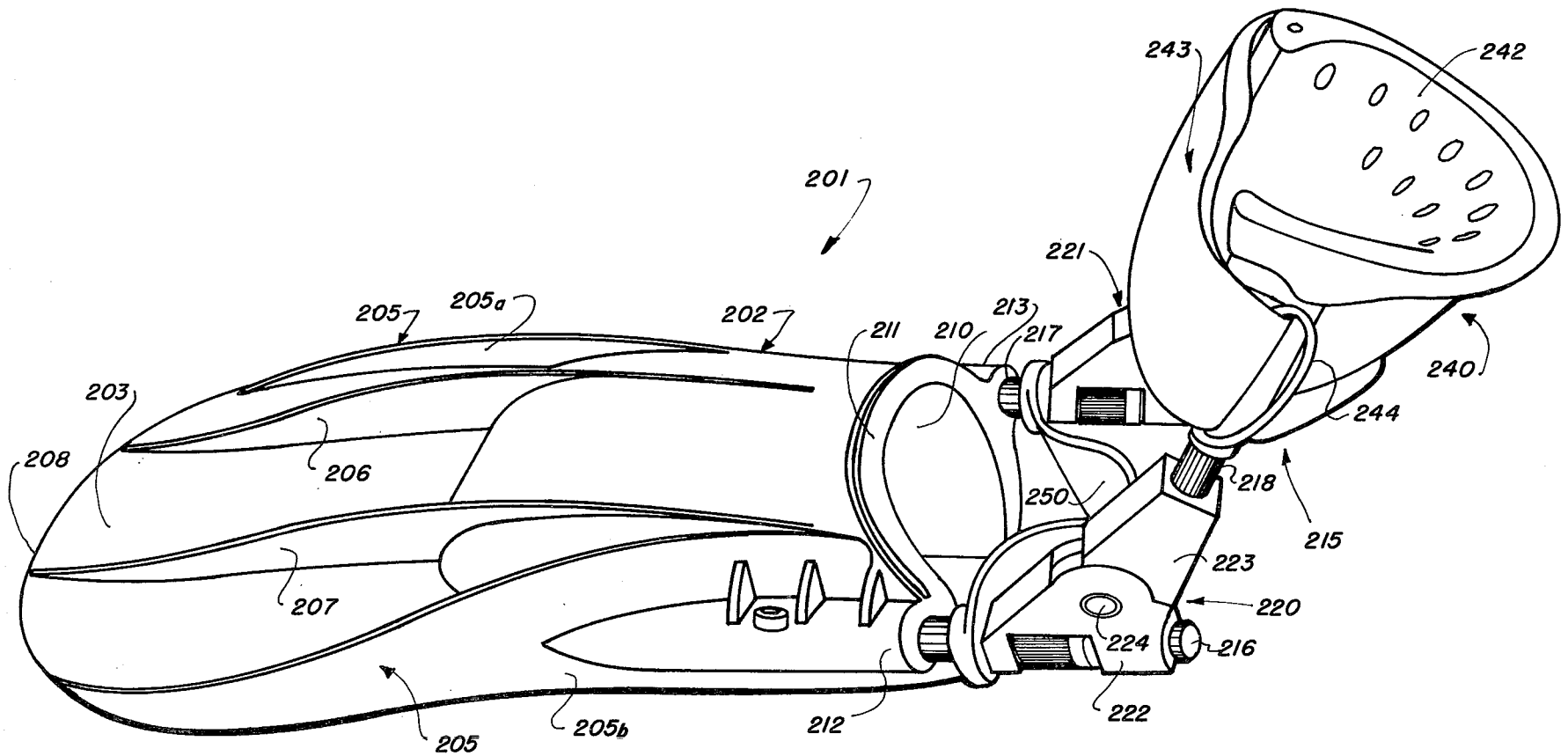
FIG. 9 is a perspective view of still another embodiment of the present invention.
Figure 10:
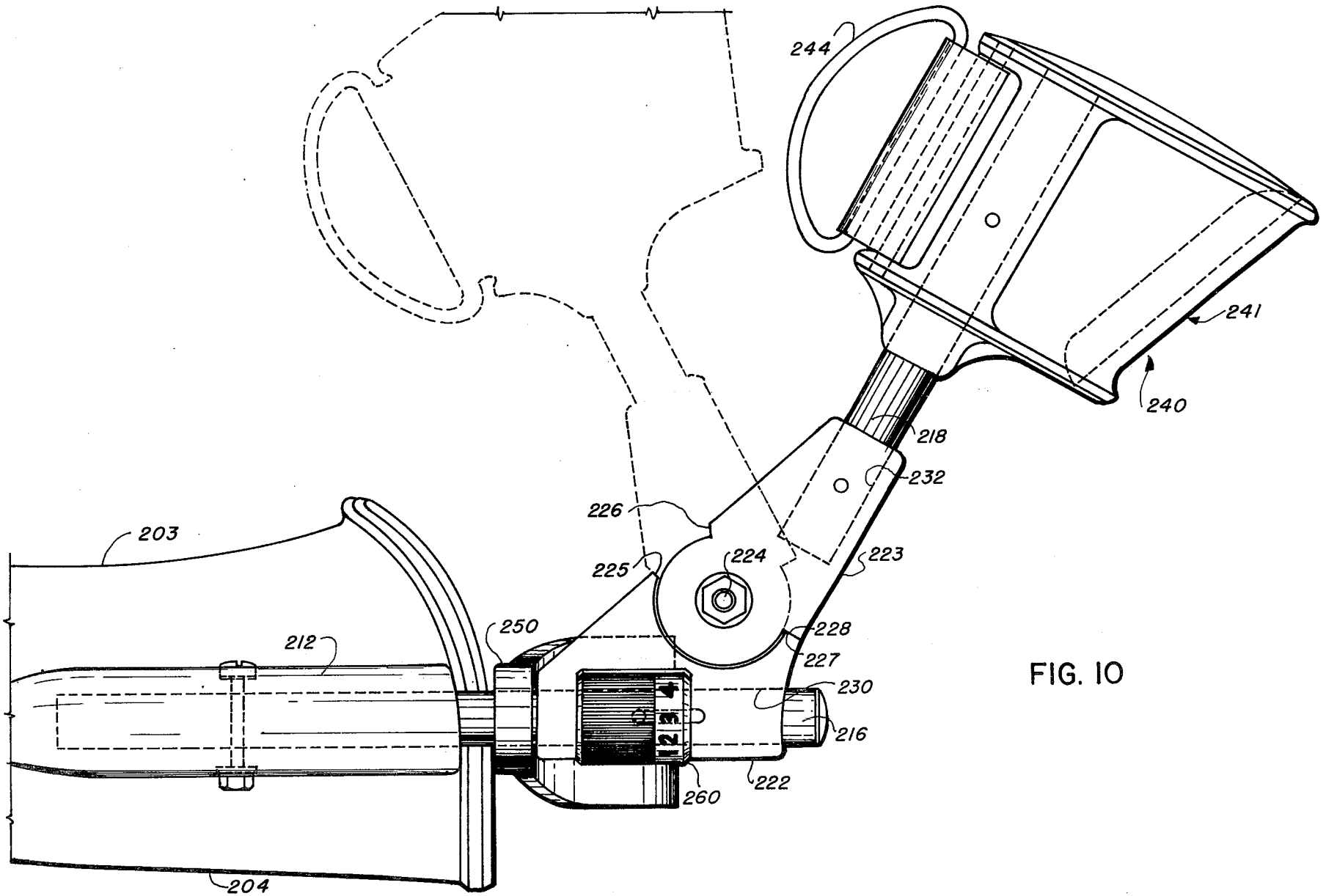
FIG. 10 is a partial side elevation view of the rear part of the fin of FIG. 9 showing in particular, in solid and broken lines, the extreme positions of said rear part.
Figure 11:
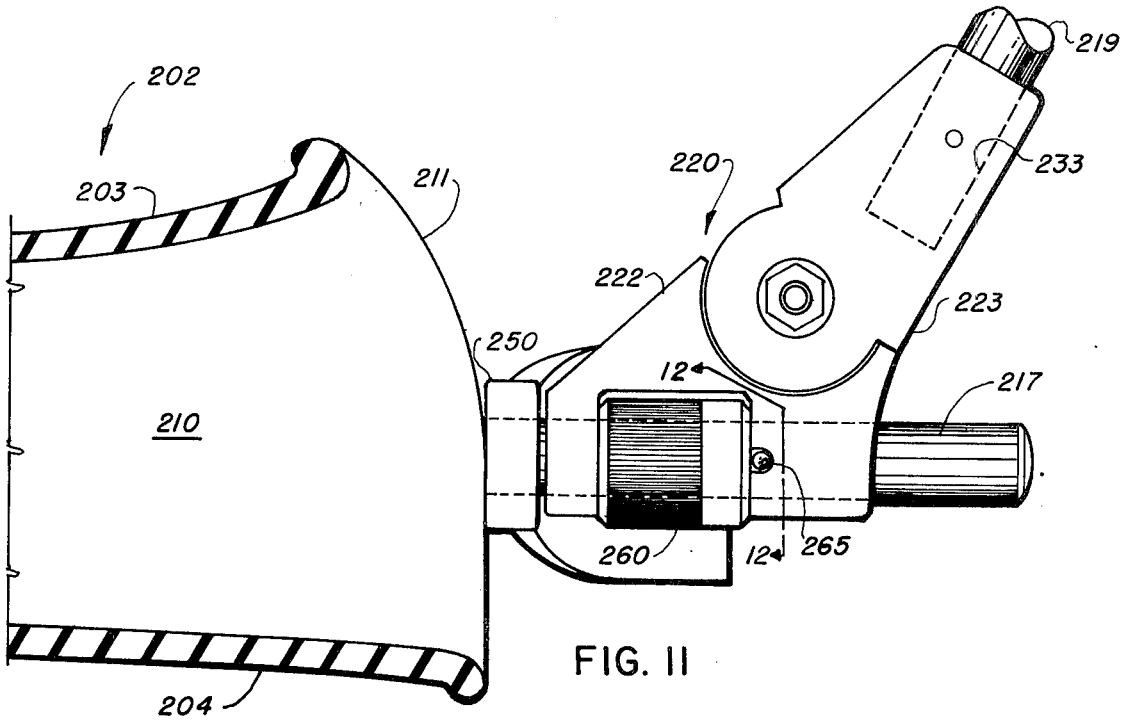
FIG. 11 is a partial cross-sectional view of a portion of the rear part of FIG. 10 emphasizing a foot-size-adjusting assembly of the present invention.

Referring to the rear portion of the fin 201 in FIG. 9, there is located on opposite sides of foot pocket 210 and centered about the parting line, a pair of tubular member-receiving members 212 and 213. Members 212 and 213 are provided for receiving and rigidly securing one end of a tubular assembly 215. In assembly 215 there is provided a pair of lower tubular members 216 and 217, a pair of upper tubular members 218 and 219 and a pair of elbow members 220 and 221. In each of the elbow members 220 and 221, there is provided a lower joint 222 and an upper joint 223. Joints 222 and 223 are coupled for relative rotation by means of a fitting such as a bolt 224 or the like. On each of joints 222 and 223, there is also provided a plurality of facing surfaces 225, 226, 227 and 228. Surfaces 225 and 227 face surfaces 226 and 228, respectively, and serve as stops for restricting fore and aft relative rotation of the joints 222 and 223. In a typical embodiment, the surfaces 225 and 226 and the surfaces 227 and 228 are positioned, respectively, for restricting a forward rotation of the joint 223 relative to the joint 222 to approximately 30°, as shown in the broken lines in FIG. 10, and a relative rearward rotation of approximately 35° from a vertical line passing through the axis of the bolt 224 when the fin is lying on a horizontal surface, as shown in the solid lines in FIG. 10. The forward rotation is provided for facilitating walking and standing while wearing the fin, while the rearward rotation is provided for allowing rearward or downward planar flexion of the foot relative to the leg during a forward thrust-producing kick stroke. In opposite ends of each of the joints 222 and 223 there is provided, respectively, two pairs of tubular member-receiving bores 230 and 231, and 232 and 233. Bores 230 and 231 are provided for slidably receiving tubular members 216 and 217, respectively. Bores 232 and 233 are provided for receiving tubular members 218 and 219, respectively.

Rigidly attached to the free ends of tubular members 218 and 219, there is provided a cuff member or assembly 240. Member 240 is provided for engaging a lower rear portion of a wearer's leg. In assembly 240, there is provided a relatively rigid semi-circular member 241. Attached to a correspondingly semi-circular interior surface of member 241 is a padding 242. Padding 242 is provided for more comfort and for reducing slippage between the cuff member 240 and the lower rear portion of the wearer's leg. This portion is typically the portion immediately below the calf of the leg. At the forward edges of the member 241 there is provided a flexible strap member 243 fitted with a D-ring 244. Strap 243 is provided for holding member 241 against the leg of a wearer. The D-ring 244 is provided to facilitate securing the strap. Typically, strap 243 is secured using the now familiar nylon hook-and-eye material wherein a plurality of nylon hooks on one part of the strap engage a correspondingly positioned plurality of nylon "eyes" on a facing part of the strap when the two parts are pulled over and pressed against each other. In practice, the strap 243 is fitted relatively loosely over the shin of the wearer since relatively little force is required to keep the cuff member 240 against the leg of the wearer.

Between the lower joints 222 and 223 and the tubular member-receiving members 212 and 213, there is provided a heel strap 50. Heel strap 250 is provided at each end with a hole for slidably receiving the lower tubular members 216 and 217. The heel strap 250 is adapted to slide on the members 216 and 217 and is provided for engaging a heel and retaining a foot in the pocket 210.

Figure 12:
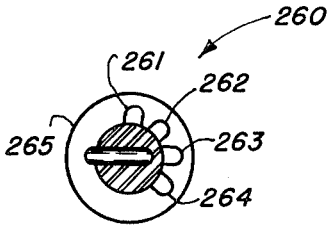
FIG. 12 is a partial cross-sectional view taken in the direction of lines 12—12 in FIG. 11.
Figure 13:
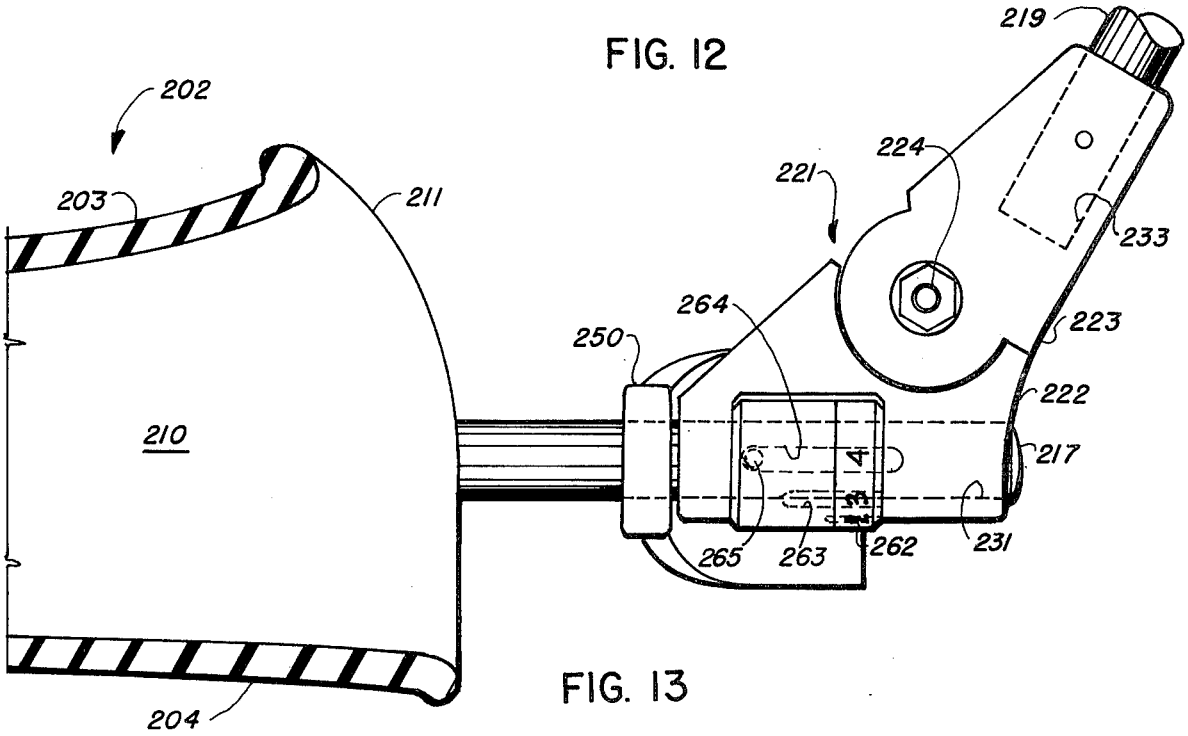
FIG. 13 is a partial cross-sectional view of a portion of the rear part of FIG. 10 showing, in hidden lines, the interior slots of the foot-size-adjusting assembly of the present invention.

To accommodate feet of different sizes there is provided for adjusting the position of the heel strap 250 and each of the lower joints 222 relative to the foot pocket 210, an adjusting knurled knob 260. Knob 260 is mounted for rotation about the lower tubular members 216 and 217 and is also adapted for slidable movement along the members 216 and 217. In the interior of the knob 260, as seen in FIGS. 12 and 13, there is provided a plurality of recesses or slots 261, 262, 263 and 264 of various lengths for receiving a pin 265 extending from each of the members 216 and 217.

To adjust the position of the lower joint 222 relative to the foot pocket 210, the joint 222 is pulled toward the foot pocket until the pin 265 clears the exterior ends of the slots 261–264 in the knob 260. The knob 260 is then rotated about the tubular member to which it is attached until the pin 265 is in registration with a desired one of the slots 261–264. Depending on the length of the slot chosen, the lower joint 222, when released from its forward position near the foot pocket 210, will be restricted more or less in its rearward movement away from the foot pocket. If the slot is short, as for example, slot 262, the rearward movement of the joint is more restricted than if a longer slot, such as slot 264, is employed. In an embodiment of the invention, a typical range of adjustment provided for the assembly 215 allows for a distance of from 8¾ to 9½ inches from the inside of the foot pocket to the back of the heel strap 250 (measured in a relaxed position).

As regards other parts of the swim fin, the blade and foot pocket are typically made of rubber, the tubular members 216, 217, 218 and 219 and joints 222 and 223 are made of stainless steel or other non-corrosive material, the semi-circular member 241 of cuff member 240 is made of a plastic material and the padding 242 is made of rubber. All parts are, of course, compatible with the kind of water, fresh or salt, in which the fin is to be used.

The embodiment described above with respect to FIGS. 9–13, as was stated with respect to the previously described embodiments of FIGS. 1–8, is subject to numerous changes in arrangement and materials which are considered well within the capability of one skilled in the art having the benefit of the present disclosure. It is contemplated, therefore, that the embodiments disclosed will not be considered other than as illustrative of the invention and that for the true scope of the invention, reference will be made to the claims hereinafter provided.

What is claimed is:

1. In a swim fin having a foot pocket, the improvement comprising:

a tubular assembly having a free end extending from a pair of opposite sides of said foot pocket;

a cuff member fitted to said free end for engaging a lower rear portion of a leg;

a heel strap coupled to said tubular assembly; and means for adjusting the position of said cuff member and said heel strap relative to said foot pocket to accommodate different sized feet.

2. In a swim fin having a foot pocket, the improvement comprising:

a tubular assembly having a free end extending from a pair of opposite sides of said foot pocket;

a cuff member fitted to said free end for engaging a lower rear portion of a leg, said tubular assembly including a lower assembly fitted to said opposite sides of said foot pocket and an upper assembly to which said cuff member is fitted; and means for allowing relative rotation of said upper and said lower assemblies through a predetermined angle about an axis transverse to the longitudinal axis of said upper and lower assemblies.

3. An improvement according to claim 2 wherein said predetermined angle is approximately 65°.

4. An improvement according to claim 2 wherein said predetermined angle extends a predetermined number of degrees on opposite sides of a vertical line which extends perpendicular to said transverse axis when said fin is lying flat on a horizontal surface.

5. An improvement according to claim 4 wherein said predetermined number of degrees is approximately 30° forward from said vertical line toward a blade extending from said foot pocket and 35° backward from said vertical line for facilitating walking and standing, and for permitting a limited amount of planar flexion of a foot during a forward thrust-producing kick stroke.

6. An improvement according to claim 2 wherein said lower assembly comprises a pair of lower tubular members, one of which is rigidly fitted to each one of said opposite sides, said upper assembly comprises a pair of upper tubular members, and said means for allowing relative rotation of said upper and lower assemblies comprises a pair of elbow members, each of said elbow members having a lower joint including a lower tubular member-receiving bore for slidably receiving an associated one of said pair of lower tubular members and an upper joint including an upper tubular member-receiving bore for receiving one of said pair of upper tubular members, each of said joints further including facing surfaces which serve as stops for restricting further rotation of associated ones of said upper and lower joints when said joints have undergone relative rotation between a predetermined first and second position corresponding to said predetermined angle; and further wherein said cuff member is rigidly supported on the ends of said upper tubular members.

7. In a swim fin having a foot pocket, the improvement comprising:

a pair of tubular members having free ends extending from a pair of opposite sides of said foot pocket; and a cuff member fitted to said free ends for engaging a lower rear portion of a leg, said cuff member comprising a relatively rigid semicircular member.

8. An improvement according to claim 7 further comprising:

flexible strap means fitted to the free ends of said cuff member against said lower rear portion of a wearer's leg; and padding means fitted to the inside surface of said cuff member for providing comfort and preventing slippage between said cuff member and said lower rear portion of said leg.

9. An improvement according to claim 8 wherein said lower rear portion of said leg is below the calf of said leg.

10. An improvement according to claim 1 wherein said tubular assembly comprises a pair of lower tubular members, one of which is rigidly fitted to each one of said opposite sides of said foot pocket, a pair of upper tubular members for supporting said cuff member and a pair of elbow members for coupling an associated one of each of said pairs of upper and lower tubular members, each of said elbow members including a lower joint having a lower tubular member-receiving bore for slidably receiving an associated one of said lower tubular members, and wherein said adjusting means for adjusting the position of said cuff member and said heel strap comprises means for selectively adjusting the position of said lower joint along said lower tubular member.

11. An improvement according to claim 10 wherein said adjusting means comprises a pin extending from said lower tubular member and a knurled knob having a plurality of recesses in its interior for receiving said pin, each of said recesses being formed with a different length for restricting the placement of said lower joint at different locations along said lower tubular member as a function of the position of said knob relative to said pin.

12. An improvement according to claim 10 wherein each of said elbow members comprises means for allowing the pivoting of said upper tubular members and cuff member relative to said lower tubular members between a predetermined first and second position.

13. An improvement according to claim 12 wherein said cuff member comprises:

a relatively rigid semicircular member;

padding means fitted in the interior of said semicircular member; and flexible strap means fitted to the ends of said semicircular member for holding said cuff member against said lower rear portion of said leg.

14. A swim fin having a foot pocket comprising:

a tubular assembly having a free end extending from opposite sides of said foot pocket;

a cuff member fitted to said free end for engaging a lower rear portion of a leg;

means located in said tubular assembly between said cuff member and said foot pocket for allowing pivoting of said cuff member relative to said foot pocket;

a heel strap slidably fitted on said tubular assembly for retaining a foot in said foot pocket; and means located in said tubular assembly between said pivoting means and said foot pocket for adjusting the position of said cuff member and said heel strap relative to said foot pocket.

15. A swim fin according to claim 14 wherein said cuff member comprises:

a relatively rigid semicircular member having a corresponding semicircular interior surface;

padding means disposed on said interior surface for providing comfort and preventing slippage; and flexible strap means fitted to said semicircular member for holding said semicircular member against a lower rear portion of a leg of a wearer.

16. A swim fin according to claim 15 wherein said lower rear portion of a leg of a wearer is the portion below the calf of said leg.

17. In a swim fin having a foot pocket, the improvement comprising:

a tubular assembly including an intermediate body portion, a first rigid portion connecting said body portion to opposite sides of said foot pocket, and a second rigid portion extending from said body portion; and a cuff member fitted to said second portion for engaging a lower rear portion of a leg.

18. An improvement of a swim fin according to claim 17 in which said body portion includes means for allowing the pivoting of said second portion with respect to said first portion.

19. An improvement of a swim fin according to claim 18 in which said pivoting means is constrained to allow pivoting only between predetermined limits, one of said limits being the optimum angle between said first and second portion for finning and the other of said limits including an angle between said first and second portion allowing the wearer of the fin to walk comfortably.

20. An improvement according to claim 17 further including a heel strap mounted to said body portion, and in which said body portion is slidably mounted to said first portion to allow adjustment of the heel strap to accommodate different sized feet.

* * * * *